US009981729B2

(12) United States Patent
Sugiyama et al.

(10) Patent No.: US 9,981,729 B2
(45) Date of Patent: May 29, 2018

(54) OUTBOARD MOTOR

(71) Applicant: SUZUKI MOTOR CORPORATION, Hamamatsu-Shi, Shizuoka (JP)

(72) Inventors: Shuichi Sugiyama, Hamamatsu (JP); Keisuke Daikoku, Hamamatsu (JP)

(73) Assignee: SUZUKI MOTOR CORPORATION, Hamamatsu-Shi, Shizuoka (JP)

( * ) Notice: Subject to any disclaimer, the term of this patent is extended or adjusted under 35 U.S.C. 154(b) by 0 days. days.

(21) Appl. No.: 15/591,505

(22) Filed: May 10, 2017

(65) Prior Publication Data

US 2017/0334537 A1 Nov. 23, 2017

(30) Foreign Application Priority Data

May 20, 2016 (JP) ..... 2016-101297

(51) Int. Cl.

| | |
|---|---|
| ***B63H 25/42*** | (2006.01) |
| ***B63H 20/34*** | (2006.01) |
| ***B63H 20/32*** | (2006.01) |
| ***B63H 20/28*** | (2006.01) |

(52) U.S. Cl.
CPC ..... *B63H 20/34* (2013.01); *B63H 20/28* (2013.01); *B63H 20/32* (2013.01); *B63H 2020/323* (2013.01)

(58) Field of Classification Search
CPC ..... B63H 20/34; B63H 20/28; B63H 20/32
See application file for complete search history.

(56) References Cited

U.S. PATENT DOCUMENTS 5,584,734 A 12/1996 Ogino et al.
6,146,223 A * 11/2000 Karls ..... B63H 20/20 440/78
6,966,806 B1 * 11/2005 Bruestle ..... B63H 20/34 440/76

FOREIGN PATENT DOCUMENTS

JP H0826189 A 1/1996

* cited by examiner

*Primary Examiner* — Stephen P Avila
(74) *Attorney, Agent, or Firm* — Troutman Sanders LLP

(57) ABSTRACT

An outboard motor includes a gear housing configured to rotatably house a propeller shaft that transmits a rotative power output from an engine to a propeller device. The gear housing includes a torpedo shape portion and a strut portion. The torpedo shape portion has a shape tapered toward a front side, and a shape biased upward toward the front side. The strut portion is disposed on an upper side of the torpedo shape portion. An outer peripheral surface of the torpedo shape portion is smoothly coupled to an outer peripheral surface of the strut portion via first to third curved surfaces. The first to third curved surfaces are each a curved surface inclined rearward and downward, a curved surface parallel to a front-rear direction, or a curved surface constituted of a part inclined rearward and downward and a part parallel to the front-rear direction.

3 Claims, 6 Drawing Sheets

OUTBOARD MOTOR

CROSS-REFERENCE TO RELATED APPLICATIONS

This application is based upon and claims the benefit of priority of the prior Japanese Patent Application No. 2016-101297, filed on May 20, 2016, the entire contents of which are incorporated herein by reference.

BACKGROUND OF THE INVENTION

Field of the Invention

The present invention relates to an outboard motor.

Description of the Related Art

A gear housing of an outboard motor includes a strut portion that rotatably houses a lower portion of a drive shaft, and a torpedo shape portion that rotatably houses a propeller shaft and is disposed on a lower side of the strut portion. Then, the gear housing has a rear side on which a propeller device is rotatably disposed. The strut portion has a width maximum on proximity of a center portion in a front-rear direction and decreased toward a front side and a rear side. This causes a flow rate of water around the strut portion during navigation to be increased on the part with the maximum width. Then, cavitation sometimes occurs rearward of the part. The cavitation causes erosion, and furthermore, when air bubbles due to the cavitation reach the propeller device, propellers' propulsion efficiency decreases. Accordingly, the strut portion and the torpedo shape portion are preferably configured to reduce the occurrence of the cavitation.

Patent Document 1 discloses a configuration where a front portion of the torpedo shape portion has a cross-sectional shape along a direction in which water flows maintaining an approximately streamline shape within a range of a change of an angle in which water flows, because a resistance that a lower case receives from the water is decreased within a range of a predetermined tilt angle. However, in the configuration in Patent Document 1, a surface for smoothly coupling the strut portion to the torpedo shape portion is inclined rearward and upward. This causes the water flowing around the strut portion and the torpedo shape portion to be guided upward (that is, the strut portion) by this surface, thus increasing an amount of the water flowing around the strut portion to increase the flow rate. Then, this configuration fails to reduce the occurrence of the cavitation around the strut portion.

Patent Document 1: Japanese Laid-open Patent Publication No. 08-26189

SUMMARY OF THE INVENTION

To solve the actual conditions, an object of the present invention is to reduce occurrence of cavitation around a strut portion.

To solve the above problem, the present invention provides an outboard motor that includes a gear housing configured to rotatably house a propeller shaft, the propeller shaft transmits a rotative power to a propeller device, and the rotative power is output from a driving force source. The gear housing includes a torpedo shape portion and a strut portion. The torpedo shape portion has a shape tapered toward a front side, and a shape biased upward toward the front side. The strut portion is disposed on an upper side of the torpedo shape portion. An outer peripheral surface of the torpedo shape portion is smoothly coupled to an outer peripheral surface of the strut portion via a curved surface inclined rearward and downward, smoothly coupled via a curved surface parallel to a front-rear direction, or smoothly coupled via the curved surface inclined rearward and downward and the curved surface parallel to the front-rear direction.

DETAILED DESCRIPTION OF THE PREFERRED EMBODIMENTS

An outboard motor according to one embodiment of the present invention is the outboard motor that includes a gear housing configured to rotatably house a propeller shaft, the propeller shaft transmits a rotative power to a propeller device, and the rotative power is output from a driving force source. The gear housing includes a torpedo shape portion and a strut portion. The torpedo shape portion has a shape tapered toward a front side, and a shape biased upward toward the front side. The strut portion is disposed on an upper side of the torpedo shape portion. An outer peripheral surface of the torpedo shape portion is smoothly coupled to an outer peripheral surface of the strut portion via a curved surface inclined rearward and downward, smoothly coupled via a curved surface parallel to a front-rear direction, or smoothly coupled via the curved surface inclined rearward and downward and the curved surface parallel to the front-rear direction. This outboard motor reduces an increase of water amount flowing toward a side surface of the strut portion, thus reducing an increase of a flow rate of the water flowing along an outer peripheral surface (side surface) of the strut portion. Accordingly, it is ensured to reduce occurrence of cavitation on the outer peripheral surface (especially, proximity of a part with a maximum width) of the strut portion.

Working Example

The following describes embodiments of the present invention in detail with reference to the drawings. The embodiments of the present invention employ an outboard motor that includes a contra-rotating propeller as an example. In the respective drawings, respective directions of the outboard motor are indicated with a three-dimensional coordinate system. In the embodiments of the present invention, an X-axis direction indicates a front-rear direction of the outboard motor, a Y-axis direction indicates a right-left direction, and a Z-axis direction indicates an up-down direction. A line S and a line T in the respective drawings are lines for the explanation of a shape of a gear housing of the outboard motor, and actually invisible (not existing) lines.

<Overall Configuration of Outboard Motor>

Figure 1:
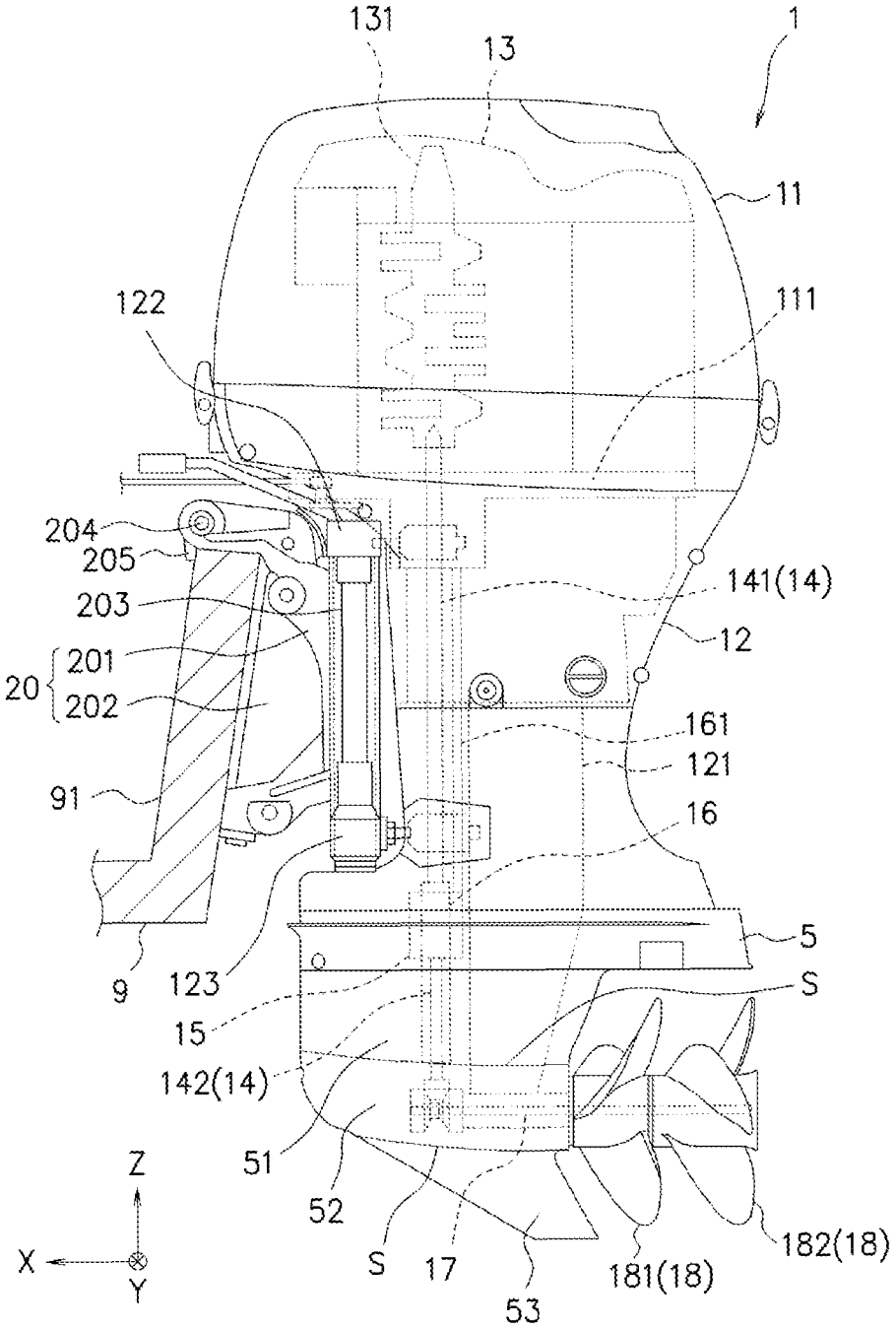
FIG. 1 is a left side view schematically illustrating an exemplary configuration of an outboard motor.
Figure 2:
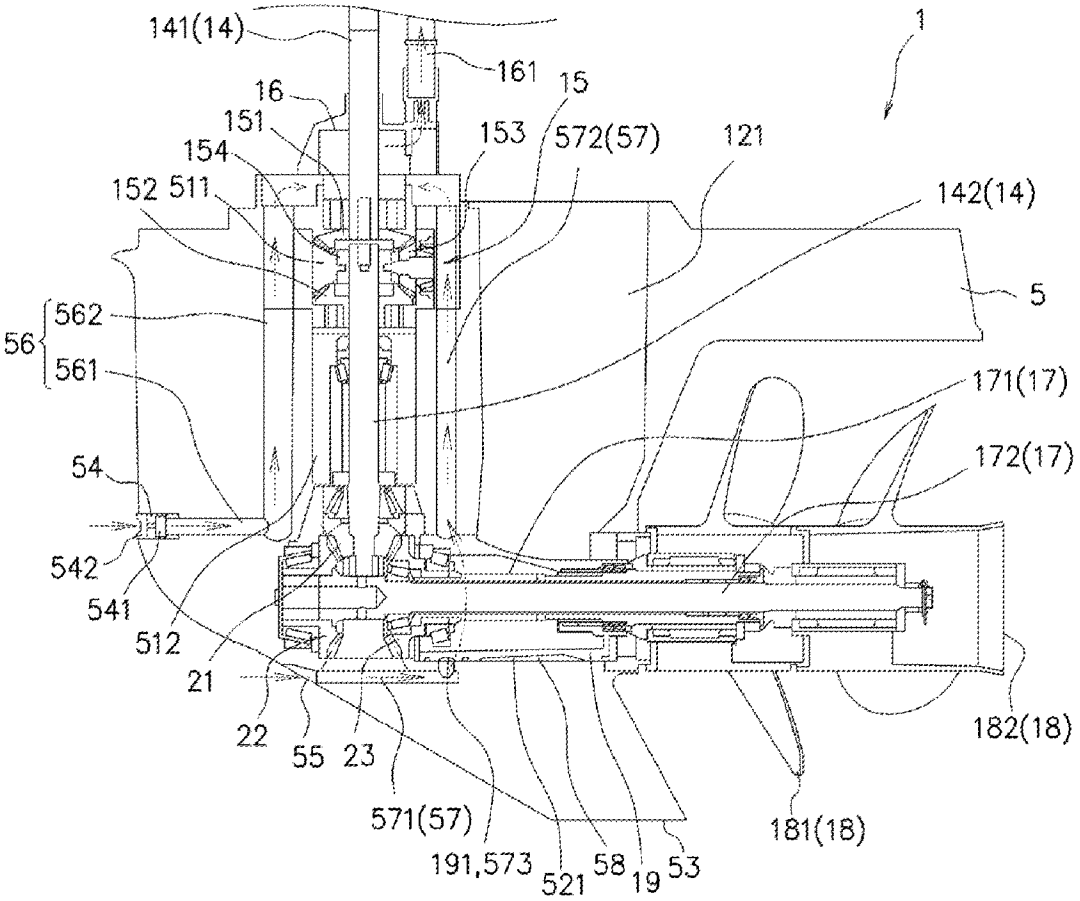
FIG. 2 is a drawing schematically illustrating an internal structure of a lower portion of the outboard motor.

First, a description will be given of an exemplary configuration of an outboard motor 1 with reference to FIG. 1 and FIG. 2. FIG. 1 is a left side view schematically illustrating an exemplary configuration of the outboard motor 1. FIG. 2 is a drawing schematically illustrating an exemplary internal structure of a lower portion of the outboard motor 1. As illustrated in FIG. 1, the outboard motor 1 is installed on such as a stern plate 91 of a ship 9 for use.

As illustrated in FIG. 1, a chassis of the outboard motor 1 includes an engine housing 11 disposed on an uppermost portion, a drive shaft housing 12 disposed on a lower side of the engine housing 11, and a gear housing 5 disposed on a lower side of the drive shaft housing 12. The engine housing 11 is constituted of, for example, a resin material and formed by such as an injection molding. The gear housing 5 and the drive shaft housing 12 are constituted of a metallic material, for example, aluminum alloy and formed by such as a casting (for example, die casting).

As illustrated in FIG. 1, a drive system of the outboard motor 1 includes an engine 13 (internal combustion engine), a drive shaft 14, a shift mechanism 15, a propeller shaft 17, a propeller device 18 (contra-rotating propeller), and a water pump 16. The engine 13 is a driving force source of the outboard motor 1, and for example, a vertical water-cooled engine is applied. The drive shaft 14 includes a first drive shaft 141 and a second drive shaft 142. The shift mechanism 15 intermittently transmits a rotative power between the first drive shaft 141 and the second drive shaft 142, and switches a rotation direction of the rotative power to be transmitted. The propeller shaft 17 transmits the rotative power output from the engine 13 from the second drive shaft 142 to the propeller device 18. The propeller shaft 17 includes an outer propeller shaft 171 and an inner propeller shaft 172. The propeller device 18 includes a front propeller device 181 and a rear propeller device 182, and the two propeller devises constitute the contra-rotating propeller. The rotative power output from the engine 13 is transmitted to each of the outer propeller shaft 171 and the inner propeller shaft 172 via the first drive shaft 141, the shift mechanism 15, and the second drive shaft 142. Then, the front propeller device 181 integrally rotates with the outer propeller shaft 171, and the rear propeller device 182 integrally rotates with the inner propeller shaft 172. This generates propulsion.

The following describes a configuration of each unit of the outboard motor 1.

The engine housing 11 internally houses the engine 13. The engine 13 is supported to an engine holder 111 inside the engine housing 11. The engine 13 is disposed in a direction such that a crankshaft 131 as a rotation output shaft has an axial direction in the up-down direction.

The drive shaft housing 12 internally houses the first drive shaft 141 and the water pump 16. The first drive shaft 141 has the axis line parallel to the up-down direction. The first drive shaft 141 has an upper end portion coupled to the crankshaft 131 of the engine 13, and a lower end portion coupled to the shift mechanism 15 described later. Then, the rotative power output from the engine 13 is transmitted to the shift mechanism 15 via the first drive shaft 141. The water pump 16 is disposed near a lower end portion of the first drive shaft 141 and on the upper side of the shift mechanism 15. The water pump 16 is coupled to the engine 13 via a water supply path 161. Then, the water pump 16 is operated by the rotation of the first drive shaft 141, so as to suction the cooling water from the outside of the outboard motor 1 to supply to the engine 13. The configuration of the water pump 16 is not specifically limited, and various kinds of known configurations are applicable. Further, the drive shaft housing 12 internally includes an exhaust path 121 for discharging exhaust air of the engine 13 to the outside on the rear side of the first drive shaft 141.

The gear housing 5 includes a strut portion 51, a torpedo shape portion 52 disposed on a lower side of the strut portion 51, and a skeg 53 disposed on a lower side of the torpedo shape portion 52. Then, the strut portion 51, the torpedo shape portion 52, and the skeg 53 are integrally formed. The strut portion 51 includes a shift mechanism chamber 511 on the inner upper side, and includes a drive shaft chamber 512 coupled to the shift mechanism chamber 511 on the lower side of the shift mechanism chamber 511. The torpedo shape portion 52 internally includes a propeller shaft chamber 521. The propeller shaft chamber 521 has an opening rear side, and is coupled to the drive shaft chamber 512 on a position closer to front.

The gear housing 5 includes a first water intake port 54 and a second water intake port 55 as the water intake port for taking in the cooling water for the engine 13. Furthermore, the gear housing 5 includes a first water intake path 56 as a path for the cooling water from the first water intake port 54 to the water pump 16, and a second water intake path 57 as a path for the cooling water from the second water intake port 55 to the water pump 16.

Furthermore, the gear housing 5 internally includes an exhaust path 58 for discharging the exhaust air of the engine 13 to the outside on the rear side of the shift mechanism chamber 511 and the drive shaft chamber 512. The exhaust path 58 disposed on the gear housing 5 has an upper side coupled to the exhaust path 121 disposed on the drive shaft housing 12, and a lower side coupled to the propeller shaft chamber 521.

The shift mechanism chamber 511 internally houses the shift mechanism 15. An exemplary configuration of the shift mechanism 15 will be described later. The drive shaft chamber 512 internally houses the second drive shaft 142 rotatably. The second drive shaft 142 is disposed on a lower side of the first drive shaft 141 coaxially with the first drive shaft 141. Then, the second drive shaft 142 is rotatably supported to the gear housing 5 by a shaft bearing such as a bearing. The second drive shaft 142 has a lower end portion on which a driving gear 21, which transmits the rotative power to the propeller shaft 17, is disposed so as to be integrally rotated with the second drive shaft 142.

The propeller shaft chamber 521 internally houses the outer propeller shaft 171 and the inner propeller shaft 172 rotatably. The outer propeller shaft 171 and the inner propeller shaft 172 are disposed coaxial to one another, thus each having the axis line in the front-rear direction. The outer propeller shaft 171 is a hollow shaft passing in an axial direction. The outer propeller shaft 171 is rotatably supported to the gear housing 5 via the bearings disposed on a bearing housing 19 and on the inner peripheral side of the bearing housing 19. The inner propeller shaft 172 has an intermediate portion of the axial direction inserted into the inside of the outer propeller shaft 171. The inner propeller shaft 172 is rotatably supported to the outer propeller shaft 171 via such as a bearing.

The outer propeller shaft 171 has a front end portion on which a rear driven gear 23 is disposed so as to integrally rotate with the outer propeller shaft 171. The rear driven gear 23 is configured to receive the rotative power transmitted from the driving gear 21 disposed on the second drive shaft 142. A front driven gear 22 is also rotatably supported to the bearing housing 19 via such as a bearing. The outer propeller shaft 171 has a rear end portion on which the front propeller device 181 is disposed via such as a shear pin so as to integrally rotate with the outer propeller shaft 171.

The inner propeller shaft 172 has a front end portion that projects forward with respect to the front end portion of the outer propeller shaft 171. Then, on this projecting portion, the front driven gear 22, which receives the rotative power transmitted from the driving gear 21 disposed on the second drive shaft 142, is disposed so as to integrally rotate with the inner propeller shaft 172. The front driven gear 22 is rotatably supported to the gear housing 5 via such as a bearing. The inner propeller shaft 172 has a rear end portion that projects rearward with respect to the rear end portion of the outer propeller shaft 171. Then, on this projecting portion, the rear propeller device 182 is disposed via such as a shear pin so as to integrally rotate with the inner propeller shaft 172.

The driving gear 21, the front driven gear 22, and the rear driven gear 23 employ a bevel gear. Then, the front driven gear 22 and the rear driven gear 23 are coaxial to one another, disposed apart from one another with a predetermined distance in the front-rear direction, and always engage with the driving gear 21 disposed on the lower end portion of the second drive shaft 142. Then, the front driven gear 22 and the rear driven gear 23 rotate in opposite directions to one another, and the front propeller device 181 and the rear propeller device 182 also rotate in opposite directions to one another. Thus, the rotative power output from the engine 13 is transmitted from the second drive shaft 142 to the propeller device 18 via the inner propeller shaft 172 and the outer propeller shaft 171.

Here, a description will be given of the exemplary configuration of the shift mechanism 15. The shift mechanism 15 includes an upper gear 151, a lower gear 152, an intermediate gear 153, and a clutch 154. The upper gear 151, the lower gear 152, and the intermediate gear 153 employ a bevel gear. The upper gear 151 is disposed on the lower end portion of the first drive shaft 141 so as to integrally rotate with the first drive shaft 141. The lower gear 152 is disposed near the upper end portion of the second drive shaft 142 so as to be relatively rotatable with respect to the second drive shaft 142. Then, the upper gear 151 and the lower gear 152 are coaxial to one another, and disposed with a predetermined distance in the up-down direction. The intermediate gear 153 is disposed between the upper gear 151 and the lower gear 152, and always engages with the upper gear 151 and the lower gear 152. Then, the upper gear 151 and the lower gear 152 rotate in opposite directions to one another. The second drive shaft 142 has the upper end portion that projects to the upper side of the lower gear 152, and on this projecting portion, the clutch 154 is disposed. The clutch 154 is reciprocatable with respect to the second drive shaft 142 in the up-down direction, and integrally rotates with the second drive shaft 142.

The lower surface of the upper gear 151, the upper surface of the lower gear 152, and both upper and lower surfaces of the clutch 154 each include teeth. When the clutch 154 moves upward such that the teeth of the clutch 154 engage with the teeth of the upper gear 151, the clutch 154 integrally rotates with the upper gear 151. In this state, the rotative power output from the engine 13 is transmitted to the second drive shaft 142 via the first drive shaft 141, the upper gear 151, and the clutch 154. Then, in this state, the second drive shaft 142 rotates in a direction identical to the first drive shaft 141. A shift position of this state is "a forward position." When the clutch 154 moves downward such that the teeth of the clutch 154 engage with the teeth of the lower gear 152, the clutch 154 integrally rotates with the lower gear 152. In this state, the rotative power output from the engine 13 is transmitted to the second drive shaft 142 via the first drive shaft 141, the upper gear 151, the intermediate gear 153, the lower gear 152, and the clutch 154. Then, in this state, the second drive shaft 142 rotates in a direction opposite to the first drive shaft 141. A shift position of this state is "a reverse position." When the clutch 154 is positioned on the middle in the up-down direction such that the teeth of the clutch 154 do not engage with any of the teeth of the upper gear 151 and the teeth of the lower gear 152, the rotative power output from the engine 13 is not transmitted to the second drive shaft 142. A shift position of this state is "a neutral position."

The outboard motor 1 further includes a bracket device 20. The bracket device 20 is disposed on a front side (especially, a front side of the drive shaft housing 12) of the chassis of the outboard motor 1. The bracket device 20 includes a swivel bracket 201 and a transom bracket 202. The swivel bracket 201 is coupled to the front side of the chassis of the outboard motor 1 via a pilot shaft 203 rotatably in a horizontal direction (swingably in the right-left direction). The pilot shaft 203 is a shaft as a steering center of the outboard motor 1. The pilot shaft 203 is secured to the front side of the chassis of the outboard motor 1 having the axis line in a direction parallel to the up-down direction (vertical direction). For example, the pilot shaft 203 has an upper end portion secured to the chassis of the outboard motor 1 via an upper mounting bracket 122, and a lower end portion secured to the chassis of the outboard motor 1 via a lower mounting bracket 123.

The transom bracket 202 is coupled to the swivel bracket 201 via a tilt shaft 204 rotatably in a pitching direction (swingably in the up-down direction). The tilt shaft 204 is secured to the swivel bracket 201 having the axis line in a direction parallel to the right-left direction. Furthermore, the transom bracket 202 includes such as a clamp 205 for an installation to such as the stern plate 91 of the ship 9. Then, the outboard motor 1 is installed on such as the stern plate 91 of the ship 9 via the transom bracket 202 of the bracket device 20. Such configuration of the bracket device 20 ensures the outboard motor 1 to be rotatable in the horizontal direction having the pilot shaft 203 as the center, and to be rotatable in the up-down direction having the tilt shaft 204 as the center, in a state of being installed to such as the stern plate 91 of the ship 9.

The upper mounting bracket 122 includes a steering bracket (not illustrated). The steering bracket is coupled to a steering wheel (not illustrated). A ship operator operates the steering wheel to steer the outboard motor 1. The outboard motor 1 includes a trim control unit (not illustrated). The trim control unit is configured to rotate the outboard motor 1 in the pitching direction by such as an oil pressure. Then, the ship operator operates the trim control unit to perform an adjustment of the tilt and the trim of the outboard motor 1.

<Shape (Outer Shape) of Gear Housing>

Figure 3:
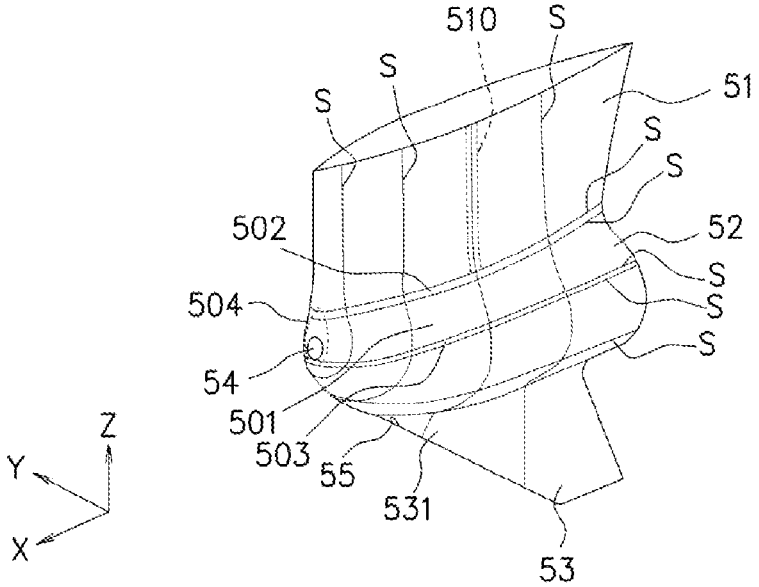
FIG. 3 is a perspective view schematically illustrating an exemplary shape (outer shape) of a gear housing.
Figure 4:
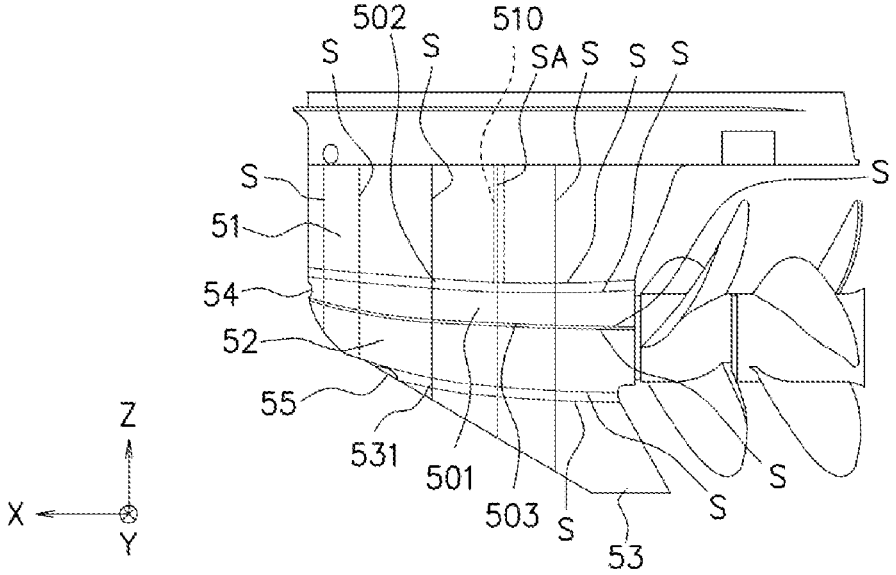
FIG. 4 is a left side view schematically illustrating an exemplary shape (outer shape) of the gear housing.
Figure 5:
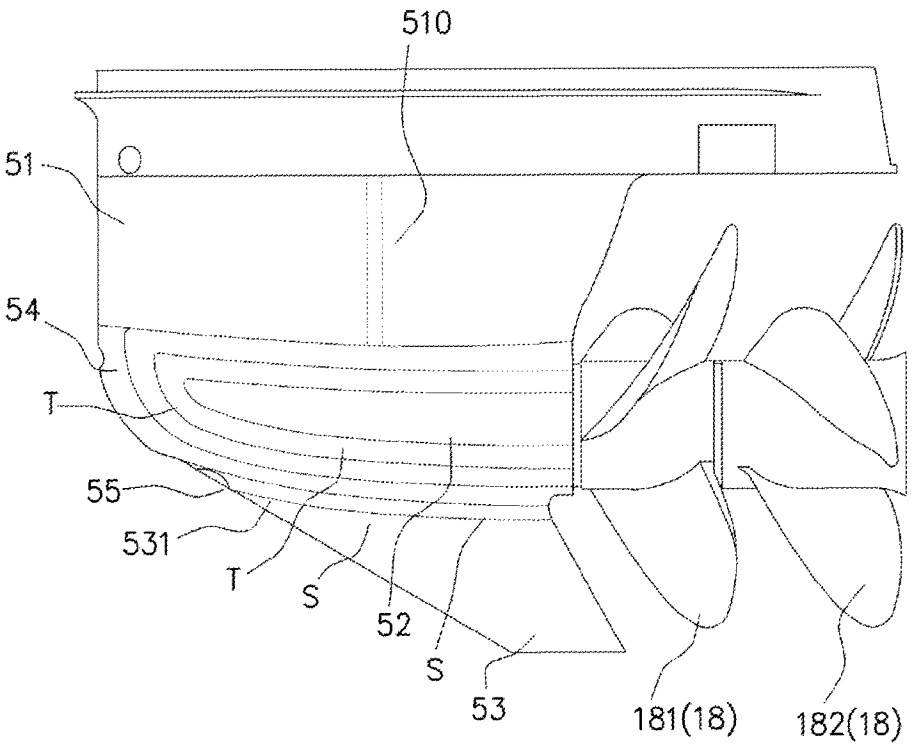
FIG. 5 is a left side view schematically illustrating an exemplary shape (outer shape) of the gear housing.

Next, a description will be given of an exemplary shape (outer shape) of the gear housing 5 with reference to FIG. 3 to FIG. 5. FIG. 3 is a perspective view schematically illustrating an exemplary shape (outer shape) of the gear housing 5. FIG. 4 is a left side view schematically illustrating the exemplary shape (outer shape) of the gear housing 5. FIG. 5 is a left side view illustrating the exemplary shape of the gear housing 5. Lines T indicated in FIG. 5 are outlines (outer shape lines) of an outer peripheral surface of the gear housing 5 appearing on cross sections when the gear housing 5 is cut on a plurality of planes (a plurality of X-Z planes having a position in the Y-axis direction different from one another) parallel to the front-rear direction and the up-down direction. As illustrated in FIG. 3 to FIG. 5, the gear housing 5 includes the strut portion 51, the torpedo shape portion 52 disposed on the lower side of the strut portion 51, and the skeg 53 disposed on the lower side of the torpedo shape portion 52. Then, the strut portion 51, the torpedo shape portion 52, and the skeg 53 are integrally formed.

As illustrated in FIG. 3, when the strut portion 51 is cut on a plane (X-Y plane) perpendicular to the up-down direction, the cross-sectional shape is an approximately spindle shape having the longer side in the front-rear direction and an approximately teardrop shape having the longer side in the front-rear direction. Specifically, a width (horizontal dimension) of the strut portion 51 is maximum on the center or the proximity of the center in the front-rear direction, and is gradually decreased toward each of the front side and the rear side from the center or the proximity of the center. Thus, the side surface of the strut portion 51 is a curved surface projecting out to both right and left outsides. The front end and the rear end of the strut portion 51 are also curved surfaces having a predetermined curvature radius viewing in the up-down direction (viewing in the Z-axis direction). However, the curvature radius of the front end and the rear end is small compared with a curvature radius of a part (curved surface projecting out to both right and left outsides) other than the front end and the rear end. For convenience of explanation, "a part of the strut portion 51 having the maximum horizontal dimension" is referred to as "a maximum width portion 510." While the respective drawings indicate the maximum width portion 510 so as to have a length to some extent in the front-rear direction, the maximum width portion 510 may have a configuration without the length in the front-rear direction.

The torpedo shape portion 52 has an approximately torpedo shape (shell shape). Specifically, the torpedo shape portion 52 has a part closer to front in a tapered shape, and a part closer to rear in an approximately cylindrical shape. The torpedo shape portion 52 has the maximum width (the horizontal dimension of the part closer to rear in the approximately cylindrical shape) greater than the maximum width of the strut portion 51. When the torpedo shape portion 52 is cut on a plane (Y-Z plane) perpendicular to the front-rear direction, the cross-sectional shape is an approximately circular shape (in other words, a shape of point symmetry (rotation symmetry) relating to the axis line of the propeller shaft 17) having the axis line (rotational center line) of the propeller shaft 17 as the center in the part closer to rear. In contrast to this, while the shape of the part in the tapered shape disposed closer to front is also an approximately circular shape viewing in the front-rear direction, the center does not correspond to the axis line of the propeller shaft 17, so as to be biased to the upper side with respect to the axis line of the propeller shaft 17. Then, the degree to be biased is increased toward the front side. Thus, the part of the torpedo shape portion 52 closer to front decreases the outer diameter toward the front side, and is biased to the upper side toward the front side. As illustrated in FIG. 3 to FIG. 5, in the side view, the position of the front end portion of the torpedo shape portion 52 approximately corresponds to the position of the front end portion of the strut portion 51.

The skeg 53 has a plate-shaped configuration projecting downward from the lower surface of the torpedo shape portion 52 to extend in the front-rear direction. When the skeg 53 is cut on a horizontal surface (X-Y plane), the cross-sectional shape is an approximately spindle shape and an approximately teardrop shape having a longer side in the front-rear direction. Thus, the skeg 53 has a sheet-shaped configuration, and the front end portion and the rear end portion each have a tapered shape such that a resistance of flowing water is decreased in the front-rear direction. The skeg 53 has a front end edge not parallel to the up-down direction but inclined rearwardly downward. The skeg 53 projects downward on the rear side of the front end portion of the torpedo shape portion 52. Accordingly, the front end portion of the skeg 53 is positioned backward of the front end portion of the torpedo shape portion 52. Then, in the side view, a lower surface of the part in the tapered shape closer to front of the torpedo shape portion 52 is smoothly coupled to the front end portion of the skeg 53.

The width (horizontal dimension) of the skeg 53 is small compared with the width of the strut portion 51 and the torpedo shape portion 52. Then, the side surface of the skeg 53 is smoothly coupled to the outer peripheral surface of the torpedo shape portion 52 via a curved surface. Specifically, the upper edge (a part near the boundary with the torpedo shape portion 52 and near the upper side in the side view) of the skeg 53 has a shape of an approximately inverted triangle and an approximately inverted trapezoidal shape (however, the oblique side is a curved line) viewing in the front-rear direction. Accordingly, the upper edge of the skeg 53 has a large width compared with the other parts of the skeg 53. For convenience of explanation, the part as the upper edge of the skeg 53 having the large width compared with the other parts is referred to as "a base portion 531."

The outer peripheral surface (especially side surface) of the strut portion 51 is smoothly coupled to the outer peripheral surface (especially side surface) of the torpedo shape portion 52 via a curved surface. The specific configuration is as follows. Between the outer peripheral surface of the strut portion 51 and the outer peripheral surface of the torpedo shape portion 52, a first curved surface 501 is disposed. The first curved surface 501 employs a curved surface gradually depressed viewing in the front-rear direction (viewing in the X-axis direction). However, the first curved surface 501 may be a surface that looks a straight line viewing in the front-rear direction. Between the outer peripheral surface of the strut portion 51 and the first curved surface 501, a second curved surface 502 is disposed. The second curved surface 502 employs a curved surface gradually depressed viewing in the front-rear direction. Then, the outer peripheral surface of the strut portion 51 is smoothly coupled to the first curved surface 501 via the second curved surface 502. Similarly, between the outer peripheral surface of the torpedo shape portion 52 and the first curved surface 501, a third curved surface 503 is disposed. The third curved surface 503 also employs a curved surface gradually depressed viewing in the front-rear direction. Then, the outer peripheral surface of the torpedo shape portion 52 is smoothly coupled to the first curved surface 501 via the third curved surface 503.

Thus, the outer peripheral surface of the strut portion 51 is smoothly coupled to the outer peripheral surface of the torpedo shape portion 52 via the first to the third curved surfaces 501 to 503. Then, viewing in the front-rear direction, the first curved surface 501 is linear or a curved surface depressed in an arc shape, and the second curved surface 502 and the third curved surface 503 are curved surfaces depressed in an arc shape. Accordingly, the outer peripheral surface of the strut portion 51 is smoothly coupled to the outer peripheral surface of the torpedo shape portion 52 via a curved surface depressed as a whole viewing in the front-rear direction.

Viewing in the front-rear direction, the curvature radiuses of the second curved surface 502 and third curved surface 503 are small compared with the curvature radius of the first curved surface 501. In FIG. 4, lines S each indicate a boundary line of the outer peripheral surface of the strut portion 51 and the second curved surface 502, a boundary line of the second curved surface 502 and the first curved surface 501, a boundary line of the first curved surface 501 and the third curved surface 503, and a boundary line of the third curved surface 503 and the outer peripheral surface of the torpedo shape portion 52. However, since these surfaces are smoothly coupled to one another, the boundary lines do not appear actually on the outer peripheral surface of the gear housing 5.

Then, the first to third curved surfaces 501 to 503, which are the curved surfaces smoothly coupling the outer peripheral surface of the strut portion 51 to the outer peripheral surface of the torpedo shape portion 52, are formed of at least one of a surface inclined rearward and downward and a surface parallel to the front-rear direction in the front side of the maximum width portion 510 of the strut portion 51. Then, on the first to third curved surfaces 501 to 503, the front side of the maximum width portion 510 of the strut portion 51 does not include a surface inclined rearward and upward. That is, as illustrated in FIG. 5, assume that the gear housing 5 is cut on a surface (X-Z plane) parallel to the front-rear direction and the up-down direction on any position in the right-left direction. In this case, an outline (outer shape line) T of the outer peripheral surface appeared on the cross section includes only a part inclined rearward and downward and a part parallel to the front-rear direction, and does not include such as a part inclined rearward and upward, in the front side of the maximum width portion 510 of the strut portion 51.

In the front side of the maximum width portion 510 of the strut portion 51, the first to third curved surfaces 501 to 503 may have any configuration of a configuration formed of only the surface inclined rearward and downward, a configuration formed of only the surface parallel to the front-rear direction, and a configuration formed of the surface inclined rearward and downward and the surface parallel to the front-rear direction. That is, in the front side of the maximum width portion 510 of the strut portion 51, it is enough for the outer peripheral surface of the strut portion 51 to be smoothly coupled to the outer peripheral surface of the torpedo shape portion 52 via only the surface inclined rearward and downward, only the surface parallel to the front-rear direction, or only the surface inclined rearward and downward and the surface parallel to the front-rear direction. Then, it is enough for the configuration that, on the first to third curved surfaces 501 to 503, the front side of the maximum width portion 510 of the strut portion 51 does not include the surface inclined rearward and upward.

For obtaining such shape, the part in the tapered shape, disposed on the torpedo shape portion 52 closer to front, employs not an approximately circular shape having the axis line of the propeller shaft 17 as the center, but a configuration biased upward toward the front side. This shape provides the gear housing 5 with the shape of the outer peripheral surface without the surface inclined rearward and upward in the front side of the maximum width portion 510 of the strut portion 51 and the part of the torpedo shape portion 52 closer to upper part. Furthermore, a configuration is employed such that a position of the front end portion of the torpedo shape portion 52 in the front-rear direction is identical to the front end portion of the strut portion 51 or rearward of the front end portion of the strut portion 51. This configuration ensures the shape without the surface inclined rearward and upward on the distal end portion of the torpedo shape portion 52. Here, "the part of the torpedo shape portion 52 closer to upper part" is a part upward of a position where the width is maximum on respective positions in the front-rear direction. For example, when a cross section of the torpedo shape portion 52 taken along a surface perpendicular to the front-rear direction has a circular shape, "the part of the torpedo shape portion 52 closer to upper part" is the upper half of the cross section.

In contrast to this, for example, when the part in the tapered shape closer to front of the torpedo shape portion 52 has an approximately circular shape (shape of the point symmetry (rotation symmetry) relating to the axis line of the propeller shaft 17) having the axis line of the propeller shaft 17 as the center, a part of the outer peripheral surface of the part in the tapered shape closer to upper part is a surface inclined rearward and upward. When the front end portion of the torpedo shape portion 52 projects forward with respect to the front end portion of the strut portion 51, a part of the outer peripheral surface of the projecting portion closer to upper part is sometimes a surface inclined rearward and upward. Therefore, in this embodiment, the above-described shape prevents the surface inclined rearward and upward from being disposed on the front side of the maximum width portion 510 of the strut portion 51 on the first to third curved surfaces 501 to 503.

These shapes of the first to third curved surfaces 501 to 503 reduce the increase of the water amount flowing from the front end portion of the torpedo shape portion 52 to the side surface of the strut portion 51 during forward navigation. That is, when the surface inclined rearward and upward is disposed on the front side of the maximum width portion 510 of the strut portion 51 on the first to third curved surfaces 501 to 503, the water around the front end portion of the torpedo shape portion 52 flows along the surface inclined rearward and upward, so as to be guided to the outer peripheral surface (side surface) of the strut portion 51. This increases the water amount flowing along the outer peripheral surface of the strut portion 51, so as to increase the flow rate. Furthermore, the strut portion 51 includes the maximum width portion 510 on the center in the front-rear direction or the proximity of the center, thus increasing the flow rate of the water flowing rearward along the outer peripheral surface of the strut portion 51 as flowing from the front end toward the maximum width portion 510. Accordingly, the cavitation easily occurs on the proximity of the maximum width portion 510 of the strut portion 51. In contrast to this, according to the embodiment, the water amount flowing toward the side surface of the strut portion 51 is reduced to increase, thus the flow rate of the water flowing along the outer peripheral surface (side surface) of the strut portion 51 is reduced to increase. Accordingly, the occurrence of the cavitation is reduced on the outer peripheral surface (especially, on the proximity of the maximum width portion 510) of the strut portion 51.

The reduction of the occurrence of the cavitation reduces the occurrence of air bubbles due to the cavitation, thus reducing the decrease of the propulsion (decrease of propellers' propulsion efficiency) due to involving of the air bubbles by the propeller device 18. Furthermore, the reduction of the occurrence of the cavitation reduces erosion.

While the embodiment of the present invention employs the configuration where the outer peripheral surface of the strut portion 51 is smoothly coupled to the outer peripheral surface of the torpedo shape portion 52 via the first to third curved surfaces 501 to 503, the configuration is not limited to this. For example, a configuration where the second curved surface 502 and the third curved surface 503 are not disposed may be employed. In short, it is simply a configuration where a surface such as inclined rearward and upward is not disposed over the outer peripheral surface of the strut portion 51 and the outer peripheral surface of the torpedo shape portion 52 in the front side of the maximum width portion 510 of the strut portion 51. This configuration provides the above-described efficiency.

On the other hand, in the rear side of the maximum width portion 510 of the strut portion 51, the first to third curved surfaces 501 to 503 may include the surface inclined rearward and upward. The part in the rear side of the maximum width portion 510 of the strut portion 51 decreases the horizontal dimension toward the rear side, thus the flow rate of the water flowing along the outer peripheral surface decreases. Then, even the configuration where the part does not include the surface inclined rearward and upward prevents the flow rate of the water flowing along the outer periphery of the strut portion 51 from increasing, or causes the degree of the increase to be low. Accordingly, the cavitation is less likely to occur.

As described above, it is preferred to be the configuration where the surface inclined rearward and upward is not disposed on the front side of the maximum width portion 510 of the strut portion 51 on the first to third curved surfaces 501 to 503. However, for example, the surface inclined rearward and upward may be disposed on the proximity of the front end portion of the torpedo shape portion 52. That is, the part of the torpedo shape portion 52 closer to front has the tapered shape getting narrow toward the front side. Then, the front end portion of the torpedo shape portion 52 has the curved surface projecting out forward. This sometimes makes difficult for the front end portion of the torpedo shape portion 52 to have the shape without the surface inclined rearward and upward. Therefore, in this case, the front end portion of the torpedo shape portion 52 may include the surface inclined rearward and upward. Here, "the front end portion of the torpedo shape portion 52" is the part that is formed in the curved surface projecting out forward and has a small curvature radius compared with the other parts.

Such shape of the gear housing 5 increases the water amount flowing toward the skeg 53. However, since the skeg 53 has the thickness (horizontal dimension) smaller than the width (horizontal dimension) of the strut portion 51, the degree of the increase of the flow rate is low compared with the strut portion 51. This reduces the occurrence of the cavitation. Furthermore, the base portion 531 of the skeg 53 is disposed closer to the axis line (rotational center) of the propeller device 18 compared with the part of the first curved surface 501 closer to the upper side and the second curved surface 502 viewing in the front-rear direction. Then, even in the case where the air bubbles are generated due to the cavitation on the base portion 531 of the skeg 53, the generated air bubbles reach the position close to the rotational center of the propeller device 18. The propulsion generated by the propeller device 18 decreases toward the center side in the radial direction (the degree contributing to the generation of the propulsion decreases as approaching the rotational center). Accordingly, when the air bubbles generated due to the cavitation reach the position close to the rotational center of the propeller device 18, the influence on the propulsion is small compared with the case where the air bubbles reach the proximity of the outer periphery of the propeller device 18.

From the front end portion of the strut portion 51 to the front end portion of the torpedo shape portion 52, typically, the torpedo shape portion 52 has the width (horizontal dimension) greater than the width of the strut portion 51. Then, in the configuration where the front end portion of the torpedo shape portion 52 is disposed on the lower side of the front end portion of the strut portion 51, the part from the front end portion of the strut portion 51 to the front end portion of the torpedo shape portion 52 possibly has an approximately inverted T-shape viewing in the front-rear direction. This shape provides a depressed portion viewing in the front-rear direction on the part over the front end portion of the strut portion 51 and the front end portion of the torpedo shape portion 52 (that is, the boundary (or the coupling portion) of the front end portion of the strut portion 51 and the front end portion of the torpedo shape portion 52. When this depressed portion is formed on the part (boundary) over the front end portion of the strut portion 51 and the front end portion of the torpedo shape portion 52, the water flow concentrates on the depressed portion to increase the flow rate during forward navigation, thus the cavitation possibly occurs.

Therefore, in this embodiment, for preventing the depressed portion from being disposed, the front end portion of the strut portion 51 has the width gradually increasing toward the lower side, thus smoothly coupling the front end portion of the strut portion 51 to the front end portion of the torpedo shape portion 52. For example, the front end portion of the strut portion 51 and the front end portion of the torpedo shape portion 52 are formed in not "the approximately inverted T-shape," but an approximately triangular shape ("approximately inverted V-shape"). This configuration does not provide the depressed portion on both right and left sides viewing in the front-rear direction on the boundary of the front end portion of the strut portion 51 and the front end portion of the torpedo shape portion 52. Accordingly, the occurrence of the cavitation is reduced from the front end portion of the strut portion 51 to the boundary of the front end portion of the torpedo shape portion 52 and its peripheral part.

<Configuration of Water Intake Port>

Figure 6:
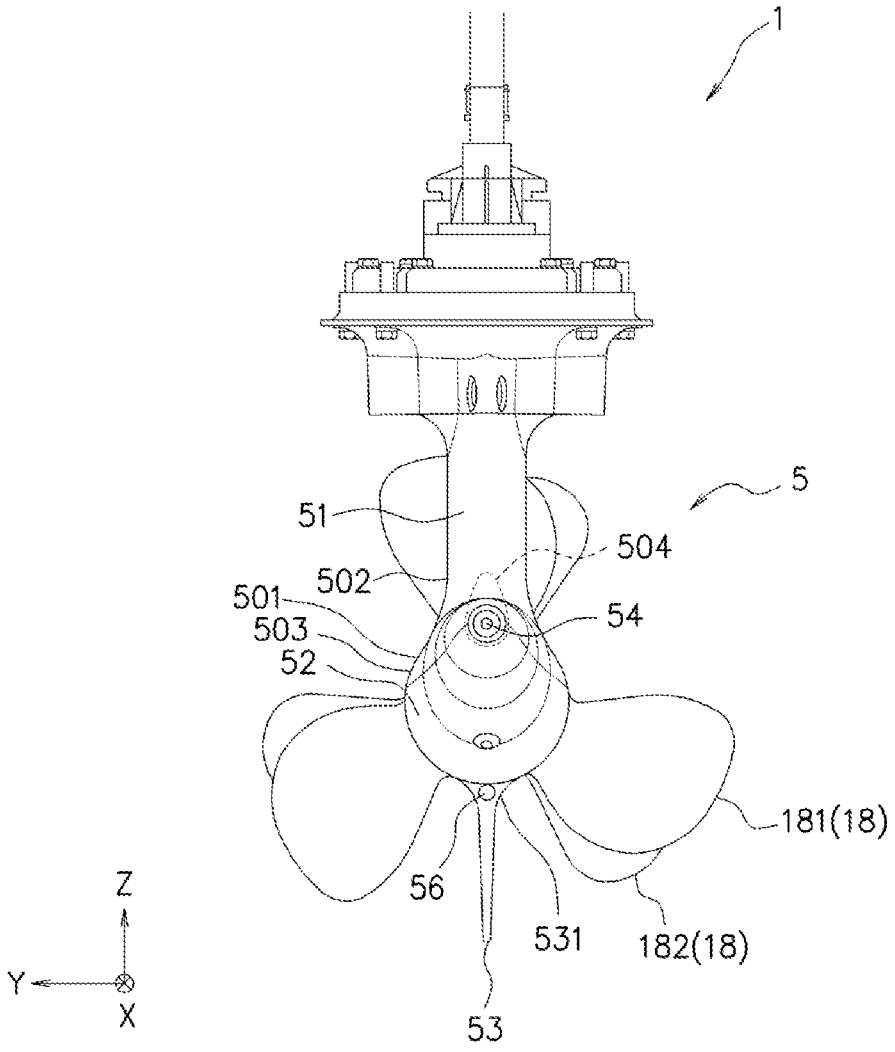
FIG. 6 is a front view of the gear housing.
Figure 7:
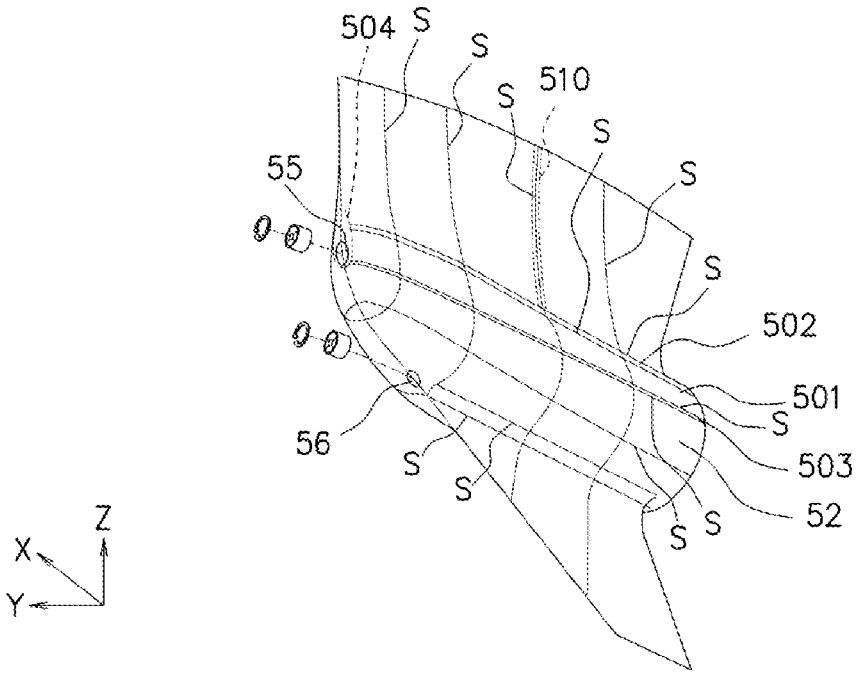
FIG. 7 is a perspective view schematically illustrating an exemplary configuration of a water intake port.

Next, a description will be given of an exemplary configuration of the water intake port for the cooling water of the engine 13 disposed on the gear housing 5 with reference to FIG. 6 and FIG. 7. FIG. 6 is a front view of the gear housing 5. FIG. 7 is a perspective view schematically illustrating an exemplary configuration of the water intake port. The gear housing 5 includes the first water intake port 54 and the second water intake port 55 as the water intake port for obtaining the cooling water for the engine 13 from outside.

As illustrated in FIG. 6 and FIG. 7, the gear housing 5 has the front end portion on which a planar portion 504 is disposed, and the first water intake port 54 is disposed on the planar portion 504. One first water intake port 54 is disposed on the gear housing 5 on the center in the right-left direction.

Here, the exemplary configuration of the planar portion 504 will be described. The planar portion 504 is a part in a planar shape perpendicular to the axis line of the propeller shaft 17 and facing forward, and includes at least a part disposed on the front end portion of the torpedo shape portion 52. This embodiment indicates a configuration where a part of the planar portion 504 closer to the lower side is disposed on the front end portion of the torpedo shape portion 52, and a part closer to the upper side is disposed on the boundary of the front end portion of the torpedo shape portion 52 and the front end portion of the strut portion 51. As described above, the front end portion of the strut portion 51 has the width gradually increasing toward the lower side, so as to be smoothly coupled to the front end portion of the torpedo shape portion 52. This makes the front end portion of the strut portion 51 and the front end portion of the torpedo shape portion 52 the approximately triangular shape ("approximately inverted V-shape"). Then, the planar portion 504 is disposed over the front end portion of the torpedo shape portion 52 and the part of the strut portion 51 closer to the lower side. This configuration makes the shape of the planar portion 504 an approximately teardrop shape and an approximately triangular shape, which are large at bottom, viewing in the front-rear direction. The planar portion 504 may be configured to be disposed only on the front end portion of the torpedo shape portion 52.

Thus, the front end portion of the torpedo shape portion 52 includes the planar portion 504. Then, the peripheral area of the planar portion 504 is smoothly coupled to the side surface of the strut portion 51 and the side surface of the torpedo shape portion 52 via a curved surface. The planar portion 504 may be a planar surface as described above, while the planar portion 504 may be a curved surface with a curvature radius equal to or more than a certain degree. However, when the planar portion 504 is the curved surface with the curvature radius equal to or more than the certain degree, the curvature radius is greater than a curvature radius of a curved surface smoothly coupling the peripheral area of the planar portion 504 to the side surface of the torpedo shape portion 52 and the side surface of the strut portion 51. The outer shape line of the planar portion 504 is smaller than the outer shape lines of the strut portion 51 and the torpedo shape portion 52 viewing in the front-rear direction. That is, on a rear side of the planar portion 504, the strut portion 51 and the torpedo shape portion 52, which have greater areas viewing in the front-rear direction compared with the planar portion 504, are disposed. In FIG. 6 and FIG. 7, the planar portion 504 is indicated by a dashed line. However, the surface of the planar portion 504 is smoothly coupled to surrounding surfaces, thus the boundary is actually invisible.

Then, the first water intake port 54 is disposed on the planar portion 504. Especially, the one first water intake port 54 is disposed on the planar portion 504 so as to be positioned on the center of the gear housing 5 in the right-left direction. The first water intake port 54 has an opening portion, whose front side is configured to be opened, for directly opposing the water flow during forward navigation. The first water intake port 54 is disposed on the upper side with respect to the axis line of the propeller shaft 17. Then, the first water intake port 54 includes a filter 541 to prevent foreign matters from entering, and the filter 541 is removably installed on the gear housing 5 by a filter retainer 542. For example, when the first water intake port 54 has the cross-sectional shape in a circular shape, an approximately cylindrically-shaped configuration where a filter element such as a net is internally disposed is applicable to the filter 541. Then, the filter 541 is buried inside the first water intake port 54 as a whole, so as to be arranged on the identical plane to the planar portion 504 or on a concaved part without projecting outside. Similarly, the filter retainer 542 is also buried inside the first water intake port 54 as a whole, so as to be arranged on the identical plane to the planar portion 504 or on a concaved part without projecting outside. The filter 541 may be configured to be maintained in a state of being buried in the first water intake port 54 without using the filter retainer 542.

In this configuration, during forward navigation, the planar portion 504 receives hydraulic pressure (dynamic pressure), thus hydraulic pressure (total pressure) on the surface of the planar portion 504 increases. Furthermore, the first water intake port 54 has the front side opening so as to directly oppose the water flow during forward navigation. This causes the water to easily flow into the first water intake port 54, thus the cooling water for the engine 13 is easily obtained. Especially, on the rear side of the planar portion 504, the strut portion 51 and the torpedo shape portion 52, whose areas are greater than the planar portion 504 viewing in the front-rear direction, are disposed. This applies higher hydraulic pressure on the surface of the planar portion 504 compared with a configuration, for example, where the planar portion 504 includes the skeg 53 on the rear side such that the skeg 53 has a small projected area viewing in the front-rear direction and a small horizontal dimension compared with the strut portion 51 and the torpedo shape portion 52.

The configuration where the one first water intake port 54 is disposed on the center of the gear housing 5 in the right-left direction increases the water intake amount. That is, the hydraulic pressure on the surface of the planar portion 504 is the highest on the center in the right-left direction. The configuration where the one first water intake port 54 is disposed on the planar portion 504 increases the total area of the opening portion compared with a configuration where a plurality of water intake ports are disposed. The configuration where the plurality of water intake ports are disposed decreases the area of the opening portion of the respective water intake ports, so as to increase resistance of water flowing into the respective water intake ports, thus resulting in failing to increase the amount of the available cooling water.

On the other hand, for example, as the conventional configuration, the configuration where the water intake port is disposed on the side surface of the strut portion 51 and the torpedo shape portion 52 generates a great output loss (a power unavailable for the propulsion of the power output from the engine 13) of the engine 13. That is, in the conventional configuration, during navigation, the water flow along the side surface of the strut portion 51 and the torpedo shape portion 52 decreases the surrounding hydraulic pressure (dynamic pressure), thus the cooling water inside the water intake port receives a force to be pumped out. Especially, while the amount of the cooling water to be obtained needs to be increased as the navigation speed increases, the above-described decrease of the hydraulic pressure also increases to increase a load on the water pump 16, thus increasing the output loss of the engine 13. In contrast to this, in this embodiment, the hydraulic pressure around the first water intake port 54 increases during forward navigation, thus preventing the generation of the output loss. Furthermore, since the hydraulic pressure around the first water intake port 54 increases as the forward navigation speed increases, the output loss of the engine 13 can be reduced while a large amount of the cooling water can be obtained during high speed navigation. Since the load on the water pump 16 can be decreased, a small-sized water pump can be employed. This ensures downsizing and weight reduction of the outboard motor 1.

The configuration where the filter 541 and the filter retainer 542 do not project from the outer peripheral surface of the gear housing 5 reduces the generation of a turbulence of the water flow on the first water intake port 54, so as to stabilize the hydraulic pressure around the first water intake port 54. This ensures the cooling water to be stably obtained from the first water intake port 54. The filter 541 is simply configured to be buried inside the first water intake port 54. Accordingly, the shape and the dimensions of the filter 541 are not specifically limited, and appropriately configured corresponding to such as the shape and the dimensions of the first water intake port 54. Similarly, the filter retainer 542 is simply configured to be buried inside the first water intake port 54, and configured such that the filter 541 is removably installed on the gear housing 5.

According to the embodiment, it is not necessarily required that the strut portion 51 and the torpedo shape portion 52 include the water intake port on the side surface. In the configuration where the strut portion 51 and the torpedo shape portion 52 include the water intake port on the side surface, the water flow along the side surfaces of the strut portion 51 and the torpedo shape portion 52 is disturbed by the water intake port, and the turbulence sometimes becomes a starting point of the cavitation. As the result, the propeller device 18 possibly involves the air bubbles due to the cavitation to decrease the propellers' propulsion efficiency, and the air bubbles due to the cavitation possibly generate the erosion. In contrast to this, in the embodiment of the present invention, the configuration where the first water intake port 54 is disposed on the planar portion 504 eliminates a need for disposing the water intake port on the side surfaces of the strut portion 51 and the torpedo shape portion 52. This reduces the occurrence of the cavitation on the side surfaces of the strut portion 51 and the torpedo shape portion 52, thus reducing the occurrence of the above problem.

The second water intake port 55 is disposed on the base portion 531 of the skeg 53. The second water intake port 55 is disposed on the lower side with respect to the axis line of the propeller shaft 17 and the lower side with respect to the propeller shaft chamber 521. Similarly to the first water intake port 54, the second water intake port 55 also employs the configuration where the front side opens directly opposing the water flow during forward navigation. Similarly to the first water intake port 54, the second water intake port 55 may be configured to include a filter. In this case, similarly to the first water intake port 54, it is preferred to be a configuration where the filter and a filter retainer are buried inside the second water intake port 55 without projecting outside.

This configuration provides the efficiency similar to the first water intake port 54. Disposing the second water intake port 55 on the base portion 531 of the skeg 53 increases the area of the opening portion of the second water intake port 55. That is, since the front edge portion of the skeg 53 has the tapered shape, the parts other than the base portion 531 on the front edge portion of the skeg 53 cannot include a large opening. In contrast to this, the base portion 531 of the skeg 53 has an approximately inverted triangle and an approximately inverted trapezoidal shape viewing in the front-rear direction, and has a great width compared with the other parts of the skeg 53. Then, disposing the second water intake port 55 on the base portion 531 of the skeg 53 increases the area of the opening portion viewing in the front-rear direction, so as to increase the amount of the cooling water to be obtained, compared with the configuration where the second water intake port 55 is disposed on the other parts. However, the area of the opening portion of the second water intake port 55 viewing in the front-rear direction is smaller than the area of the opening portion of the first water intake port 54 viewing in the front-rear direction (the efficiency will be described below).

As described above, the tapered shaped part disposed on the torpedo shape portion 52 closer to front is biased to the upper side toward the front side. This configuration increases the water amount flowing to the lower side of the torpedo shape portion 52 during forward navigation, compared with the configuration where the tapered shaped part disposed on the torpedo shape portion 52 closer to front has an approximately circular shape having the axis line of the propeller shaft 17 as the center. Accordingly, during forward navigation, the flow rate of the water increases on the proximity of the front end portion of the base portion 531 of the skeg 53, thus increasing the amount of the cooling water obtained from the second water intake port 55.

Furthermore, in the configuration where the second water intake port 55 is disposed on the base portion 531 of the skeg 53, when the cavitation occurs on the second water intake port 55 or its periphery as a starting point, the decrease of the propulsion (decrease of the propellers' propulsion efficiency) can be reduced. That is, the base portion 531 of the skeg 53 is close to the outer peripheral surface of the torpedo shape portion 52, and is close to the rotational center of the propeller device 18 viewing in the front-rear direction compared with the other parts of the skeg 53, the second curved surface 502, and the part of the first curved surface 501 closer to the upper side. Then, when the air bubbles due to the cavitation are generated on the base portion 531 of the skeg 53, the generated air bubbles reach the position close to the rotational center of the propeller device 18. Since the propulsion generated by the propeller device 18 decreases from the outer peripheral side toward the rotational center, when the air bubbles reach the position close to the rotational center of the propeller device 18, the influence on the propulsion decreases compared with the case where the air bubbles reach the proximity of the outer periphery of the propeller device 18. This reduces the decrease of the propulsion (decrease of the propellers' propulsion efficiency) due to involving the air bubbles by the propeller device 18.

Furthermore, a front edge (front side in the side view) including the front end portion of the skeg 53 is inclined rearward and downward in the side view. Then, even when such as a floating matter in water is caught on the front end portion of the skeg 53 during forward navigation, the water flow pushes the floating matter obliquely rearward to the lower side so as to cause the floating matter to be easily removed from the skeg 53. This prevents the second water intake port 55 from being in a state covered with such as a floating matter in water for a long period of time.

The first water intake port 54 and the second water intake port 55 are disposed on the positions apart from one another in the front-rear direction and the up-down direction. In the configuration where the first water intake port 54 and the second water intake port 55 are disposed on the gear housing 5, even when one water intake port is covered with such as a foreign matter, the cooling water can be continued to be obtained insofar as the other water intake port is not covered. Then, according to the embodiment, the first water intake port 54 and the second water intake port 55 are disposed on the positions apart from one another, thus reducing the possibility of the occurrence of a state where the first water intake port 54 and the second water intake port 55 are simultaneously covered with the foreign matter.

<Configuration of Water Intake Path>

Next, a description will be given of a configuration of the water intake path with reference to FIG. 2 and FIG. 8. As illustrated in FIG. 2, the gear housing 5 internally includes the first water intake path 56 as a path for the cooling water from the first water intake port 54 to the water pump 16, and the second water intake path 57 as a path for the cooling water from the second water intake port 55 to the water pump 16. The first water intake path 56 is coupled to the second water intake path 57 in front of the water pump 16 (upstream side of the flowing direction of the cooling water viewing from the water pump 16).

The first water intake path 56 includes a horizontal portion 561 and a vertical portion 562. The horizontal portion 561 has the axis line approximately parallel (that is, approximately horizontal) to the front-rear direction, and is a part extending rearward from the first water intake port 54. The vertical portion 562 has the axis line approximately parallel (that is, approximately vertical) to the up-down direction, and is a part extending upward from the rear end of the horizontal portion 561. The horizontal portion 561 of the first water intake path 56 has at least apart disposed on the upper side with respect to the propeller shaft chamber 521. The vertical portion 562 of the first water intake path 56 is disposed on the front side of the drive shaft chamber 512. The water (cooling water) entered from the first water intake port 54 sequentially passes the horizontal portion 561 and the vertical portion 562 to flow into the water pump 16.

The second water intake path 57 includes a horizontal portion 571, an annular portion 573, and a vertical portion 572. The horizontal portion 571 has the axis line approximately parallel to the front-rear direction, and is a part extending rearward from the second water intake port 55. As illustrated in FIG. 2, the horizontal portion 571 of the second water intake path 57 is disposed on the inside of the base portion 531 of the skeg 53 so as to be positioned on the lower side of the propeller shaft chamber 521. Then, the rear end portion of the second water intake path 57 is coupled to the inside of the propeller shaft chamber 521 via an opening portion disposed on the proximity of the bottom portion of the inner peripheral surface of the propeller shaft chamber 521. The second water intake path 57 has a lower end portion coupled to the inner peripheral surface of the propeller shaft chamber 521, and an upper end portion coupled to the water pump 16. Then, the propeller shaft chamber 521 internally houses the bearing housing 19, and the bearing housing 19 and the inner peripheral surface of the propeller shaft chamber 521 form the annular portion 573.

Figure 8:
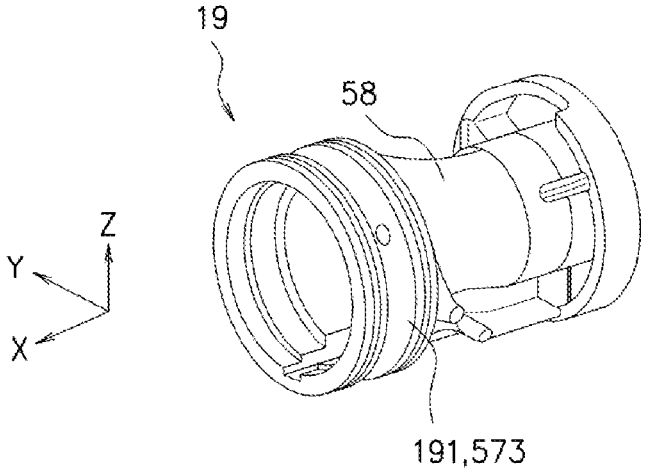
FIG. 8 is an external perspective view schematically illustrating an exemplary configuration of a bearing housing.

FIG. 8 is an external perspective view schematically illustrating an exemplary configuration of the bearing housing 19. As illustrated in FIG. 8, the bearing housing 19 has an approximately cylindrical shape. The bearing housing 19 has the outer peripheral surface on which an annular groove 191 extending in the circumferential direction is disposed. Housing the bearing housing 19 inside the propeller shaft chamber 521 forms the annular portion 573 as a circular space by the annular groove 191 of the bearing housing 19 and the inner peripheral surface of the propeller shaft chamber 521. Then, an opening portion coupled to the horizontal portion 571 of the second water intake port 55 and an opening portion as the lower end portion of the vertical portion 572 are positioned inside the annular groove 191. Accordingly, the horizontal portion 571 of the second water intake path 57 is coupled to the vertical portion 572 via the annular portion 573 such that the cooling water can flow through.

This configuration causes the cooling water entered from the second water intake port 55 to pass through the horizontal portion 571 of the second water intake path 57, so as to flow into the annular portion 573 from the opening portion disposed on the proximity of the bottom portion of the propeller shaft chamber 521. Then, the cooling water passed through the annular portion 573 flows into the vertical portion 572 of the second water intake path 57, so as to pass through the vertical portion 572 of the second water intake path 57 to reach the water pump 16. Thus, in this embodiment, the bearing housing 19, which rotatably supports the outer propeller shaft 171, includes apart of the second water intake path 57. This configuration prevents the configuration of the second water intake path 57 from being complicated because the second water intake path 57 is not required to be bypassed from the propeller shaft chamber 521 in the configuration where the second water intake path 57 is disposed on the lower side of the propeller shaft chamber 521.

The vertical portion 562 of the first water intake path 56 and the vertical portion 572 of the second water intake path 57 are coupled to one another on each upper end portion. Then, when a difference occurs in the hydraulic pressure between the peripheral area of the first water intake port 54 and the peripheral area of the second water intake port 55, the water pump 16 receives an average hydraulic pressure of these hydraulic pressures. Furthermore, for example, when the hydraulic pressure around the first water intake port 54 is higher than the hydraulic pressure around the second water intake port 55, the cooling water entered from the first water intake port 54 possibly passes through the first water intake path 56 and the second water intake path 57 to flow out from the second water intake port 55. Therefore, as described above, the area of the opening portion of the second water intake port 55 viewing in the front-rear direction is configured to be small compared with the area of the opening portion of the first water intake port 54 viewing in the front-rear direction. Furthermore, the cross-sectional area of the flow path of the second water intake path 57 is configured to be small compared with the cross-sectional area of the flow path of the first water intake path 56. Thus, the resistance of the flow of the cooling water in the second water intake port 55 and the second water intake path 57 is configured to be large compared with the first water intake port 54 and the first water intake path 56. This configuration reduces the decrease of the hydraulic pressure in front of the water pump 16. This configuration also inhibits the cooling water, entered from the first water intake port 54 to pass through the first water intake path 56, to pass through the second water intake path 57 to flow out from the second water intake port 55 to the outside. Accordingly, the decrease of the amount of the cooling water obtained by the water pump 16 is reduced.

While this embodiment indicates the configuration where the area of the opening portion of the second water intake port 55 is smaller than the area of the opening portion of the first water intake port 54 and the cross-sectional area of the flow path of the second water intake path 57 is smaller than the cross-sectional area of the flow path of the first water intake path 56, the configuration is not limited to this. For example, a configuration may be employed such that the area of the opening portion of the second water intake port 55 is smaller than the area of the opening portion of the first water intake port 54 while the cross-sectional area of the flow path of the second water intake path 57 is approximately identical to the cross-sectional area of the flow path of the first water intake path 56. A configuration may be employed such that the area of the opening portion of the second water intake port 55 is approximately identical to the area of the opening portion of the first water intake port 54 while the cross-sectional area of the flow path of the second water intake path 57 is smaller than the cross-sectional area of the flow path of the first water intake path 56. These configurations also provide the above efficiency.

As described above, the embodiment of the present invention has been described in detail with reference to the drawings. However, the above-described embodiment merely indicates a concrete example for exploitation of the present invention. The technical scope of the present invention is not limited to the above-described embodiment. Various modifications of the present invention can be made without departing from its spirit, such modifications being included within the technical scope of this invention.

For example, while the above embodiment indicates the outboard motor with the contra-rotating propeller, the outboard motor to which the present invention is applicable is not limited to the outboard motor with the contra-rotating propeller. While the outboard motor that includes an engine as the driving force source is indicated, the present invention is also applicable to an outboard motor that includes an electric motor as the driving force source.

The present invention is a technique appropriate for an outboard motor. According to the present invention, it is ensured to reduce the occurrence of the cavitation around the strut portion.

According to the present invention, it is ensured to reduce the occurrence of the cavitation around the strut portion.

What is claimed is:

1. An outboard motor comprising:

a gear housing configured to rotatably house a propeller shaft, the propeller shaft transmitting a rotative power to a propeller device, the rotative power being output from a driving force source, wherein the gear housing comprises:

a torpedo shape portion that has a shape tapered toward a front side, and a shape biased upward toward the front side, a skeg integrally disposed on a lower side of the torpedo shape portion so as to project downward on a position rearward of a front end portion of the torpedo shape portion, wherein the skeg comprises a front end portion on which a first water intake port is disposed to obtain cooling water cooling the driving force source such that the first water intake port opens forward, and a strut portion disposed on an upper side of the torpedo shape portion, an outer peripheral surface of the torpedo shape portion is smoothly coupled to an outer peripheral surface of the strut portion via a curved surface inclined rearward and downward, smoothly coupled via a curved surface parallel to a front-rear direction, or smoothly coupled via the curved surface inclined rearward and downward and the curved surface parallel to the front-rear direction.

2. The outboard motor according to claim 1, wherein the torpedo shape portion has a front end portion on which a second water intake port is disposed to obtain cooling water cooling the driving force source such that the second water intake port opens forward.

3. The outboard motor according to claim 1, wherein the skeg has an upper edge including a part with a large width compared with other parts of the skeg, and the first water intake port is disposed on the part with the large width compared with the other parts.

* * * * *